United States Patent [19]

Anderson

[11] Patent Number: 4,506,537

[45] Date of Patent: Mar. 26, 1985

[54] DIE FOR SPLINING THIN-WALL POWER TRANSMITTING MEMBERS

[75] Inventor: Carl E. Anderson, Clinton Township, Macomb County, Mich.

[73] Assignee: Anderson-Cook, Inc., Fraser, Mich.

[21] Appl. No.: 447,244

[22] Filed: Dec. 6, 1982

[51] Int. Cl.[3] ..... B21D 17/04; B21D 9/14

[52] U.S. Cl. ..... 72/469; 72/88

[58] Field of Search ..... 72/469, 88, 90

[56] References Cited

U.S. PATENT DOCUMENTS

| | | | |
|---|---|---|---|
| 3,827,280 | 8/1974 | Miller et al. | 72/469 |
| 3,874,219 | 4/1975 | Miller et al. | 72/469 |
| 3,982,415 | 9/1976 | Killop | 72/88 |
| 4,028,921 | 6/1977 | Blue | 72/469 |
| 4,028,922 | 6/1977 | Killop | 72/88 |
| 4,045,988 | 9/1977 | Anderson | 72/108 |
| 4,155,237 | 5/1979 | Jungesjo | 72/88 |

FOREIGN PATENT DOCUMENTS

| | | | |
|---|---|---|---|
| 123392 | 10/1959 | U.S.S.R. | 72/90 |

*Primary Examiner*—Daniel C. Crane

*Attorney, Agent, or Firm*—Reising, Ethington, Barnard, Perry & Milton

[57] ABSTRACT

An improved die (20) and method for splining a thin-wall sleeve (22) of a power transmitting member by meshing die teeth (32) and teeth (28) of a toothed mandrel (26) on which the sleeve is mounted between the meshing teeth. The die (20) is preferably embodied by an elongated die rack and includes a toothed forming face (30) having a plurality of leading tooth groups (**32*a*,32*b*) of a progressively changing height from one tooth to the next tooth of the same group. Each of the tooth groups has a length for splining an arcuate segment of the sleeve of no more than ninety degrees and has an average tooth height that is approximately equal to the average tooth height of each other leading tooth group. A stepped tooth group (32*c*) and a trailing tooth group (32*d*) of full teeth complete the thin-wall splining after the initial partial splining performed by the leading tooth groups. In the preferred construction, there are three leading tooth groups (32*a*) each of which has teeth of a progressively increasing height and there are three leading tooth groups (32*b*) each of which has teeth of a progressively decreasing height. Between the leading tooth groups and the stepped tooth group which precedes the trailing tooth group, the die rack (20) has a sizing recess (74**) of a length that permits the trailing tooth group to commence the full splining in a manner that eliminates any out of roundness of the splined sleeve.

15 Claims, 12 Drawing Figures

DIE FOR SPLINING THIN-WALL POWER TRANSMITTING MEMBERS

TECHNICAL FIELD

This invention relates to a die and a method for splining thin-wall power transmitting members by a rolling operation.

BACKGROUND ART

U.S. Pat. No. 3,982,415, which is assigned to the assignee of the present application, discloses a rolling operation for forming splines in thin-wall sleeves of power transmitting members. This rolling operation is performed by mounting the thin-wall sleeve on a toothed mandrel that is located between a pair of toothed dies. Movement of the pair of dies in opposite directions as each other meshes the die and mandrel teeth with the sleeve therebetween to form the splines at diametrically opposite locations while the mandrel rotates in coordination with the die movement. Vehicle automatic transmissions conventionally incorporate the type of splined sleeve that can be formed by this thin-wall spline rolling operation much more economically than impact splining that was previously utilized to perform the splining.

U.S. Pat. No. 4,028,922, which is also assigned to the assignee of the present application, discloses dies which have a particular toothed forming face construction for performing thin-wall sleeve splining in accordance with the process discussed above. These dies are disclosed as either being of the straight gear rack type or of a rotary type such as disclosed by U.S. Pat. No. 4,045,988 which is also assigned to the assignee of the present application.

U.S. Pat. No. 4,155,237, which is likewise assigned to the assignee of the present application, discloses a thin-wall sleeve splining machine of the type discussed above with an automatic loader used to mount and remove the sleeve from the mandrel. Loading and unloading members of the machine loader cooperate with each other to move the sleeve onto the mandrel for the splining operation and to thereafter remove the splined sleeve in preparation for the next cycle.

DISCLOSURE OF INVENTION

An object of the present invention is to provide an improved die and method for splining thin-wall power transmitting members.

In carrying out the above object, a toothed die embodying the invention is used to form splines in a thin-wall annular sleeve of a power transmitting member by meshing the die teeth and teeth of a toothed mandrel on which the sleeve is mounted between the meshing teeth so as to thereby form thin-wall splines in the sleeve as the mandrel rotates about a central axis. A toothed forming face of the die includes a plurality of leading tooth groups each of which includes partial teeth of a progressively changing height from one tooth to the next tooth of the same group. Each of these leading tooth groups has a length for splining an arcuate segment of the sleeve of no more than ninety degrees and has an average tooth height that is approximately equal to the average tooth height of each other leading tooth group. The toothed forming face of the die also includes a trailing tooth group of full teeth for completing the thin-wall splining.

Thin-wall sleeve splining can be performed by this die and method on thin-wall metal sleeves of harder and tougher metal than was previously possible. As such, more durable splined thin-wall sleeves can be produced as may be required in certain applications.

A pair of cooperable dies and an associated toothed mandrel are used to perform the thin-wall splining with the sleeve mounted on the mandrel between the dies. The die and mandrel teeth mesh with each other at diametrically opposite locations with the sleeve therebetween to form the splines. Preferably, the die comprises an elongated die rack having leading and trailing ends and also has a rectilinear pitch line along which the leading and trailing tooth groups extend. The partial teeth of each leading tooth group preferably have angled tips that extend in an angular relationship to the pitch line in the same plane as each other. This angled tooth tip construction is readily manufactured starting with a rack having full teeth and then grinding the leading tips angularly to provide the leading tooth groups with teeth of a progressively changing height.

The invention can be embodied by a die rack having at least two of the leading tooth groups each of which has a progressively increasing height in a direction from the leading end of the rack toward the trailing end of the rack. It is also possible to embody the invention by a die rack having at least two of the leading tooth groups each of which has teeth of a progressively decreasing height in a direction from the leading end of the rack toward the trailing end of the rack. Furthermore, the invention can be embodied by a die rack having at least one of the leading tooth groups with teeth of a progressively increasing height in a direction from the leading end of the rack toward the trailing end of the rack and also having at least one other leading tooth group whose teeth have a progressively decreasing height in a direction from the leading end of the rack toward the trailing end of the rack.

In its most preferred construction, the die rack has a plurality of the leading tooth groups with teeth of a progressively increasing height in a direction from the leading end of the rack toward the trailing end of the rack and another plurality of the leading tooth groups with teeth of a progressively decreasing height in a direction from the leading end of the rack toward the trailing end of the rack. The leading tooth groups having the teeth of progressively increasing height are located immediately adjacent the leading end of the rack, while the tooth groups having the teeth of progressively decreasing height are located toward the trailing end of the rack from the tooth groups having the teeth of progressively increasing height. Three of each of these leading tooth groups are most preferably provided such that each leading tooth group partially splines a sixty degree arcuate segment of the sleeve.

Preferably, the die rack also includes a sizing recess located between the leading tooth groups and the trailing tooth group. During the initial partial splining, a slightly out of round condition usually is imparted to the partially splined sleeve such that the sleeve has perpendicular major and minor diameters that give the sleeve a slightly elliptical shape. The sizing recess of the die rack has a length equal to about one sixth of circumference of the sleeve such that the sleeve is initially engaged after the sizing recess at a location about two thirds of the distance from the minor diameter to the major diameter of the out of round shape imparted to the sleeve by the partial spline forming. Such initial engagement with the partially splined sleeve and the subsequent full splining that takes place imparts roundness to the fully splined sleeve.

The toothed forming face of the die rack also preferably includes a stepped tooth group located between the sizing recess and the trailing tooth group of full teeth. The stepped tooth group has teeth of a progressively increasing height from the sizing recess toward the trailing tooth group of full teeth. Best results are achieved with the stepped tooth group having a length equal to about one half the circumference of the sleeve to be splined.

After the splines have been fully formed by the trailing tooth group, the die rack is moved in a reverse direction to position the fully splined sleeve in the sizing recess for removal from the mandrel in preparation for the next cycle. It is also possible for the trailing end of the die rack to have a taper that extends away from the central axis to mandrel rotation so as to disengage the sleeve after splining to permit removal of the splined sleeve from the mandrel.

In carrying out the above object, the invention also involves the method for forming splines in the thin-wall annular sleeve of the power transmitting member by meshing teeth of a pair of the dies and teeth of a rotatable mandrel on which the sleeve is mounted between the meshing teeth so as to thereby form thin-wall splines in the sleeve as the mandrel rotates about the central axis. The improvement involves initially forming the complete sleeve in arcuate segments of no more than ninety degrees with parital splines of a progressively changing depth along each segment with the average depth therealong being approximately equal to the average spline depth along each other segment. After the partial splining, the splines are fully formed to complete the spline forming the operation.

In carrying out the thin-wall splining method, the sleeve is preferably initially formed with partial splines of progressively changing depth along arcuate segments of sixty degrees. As previously mentioned, this is accomplished by a pair of the die racks each of which has at least three of the leading tooth groups of a length for splining a sixty degree arcuate segment of the sleeve.

In the most preferred practice of the thin-wall splining method, the shallower splines of less than the average depth along each partially formed arcuate segment are further progressively formed in the opposite direction as the deeper splines thereof prior to the full forming of the splines. This two-stage partial forming of the splines is accomplished by the provision of the leading tooth groups on the die rack with teeth of progressively changing height in opposite directions as previously mentioned.

After the partial forming of the splines, the full spline forming proceeds commencing about two thirds of the distance from the minor diameter toward the major diameter of an out of round shape which is imparted to the sleeve by the initial partial spline forming. Completing the full forming of the splines after commencing at this location between the major and minor diameters of the slightly elliptical shape of the sleeve provides roundness to the sleeve.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
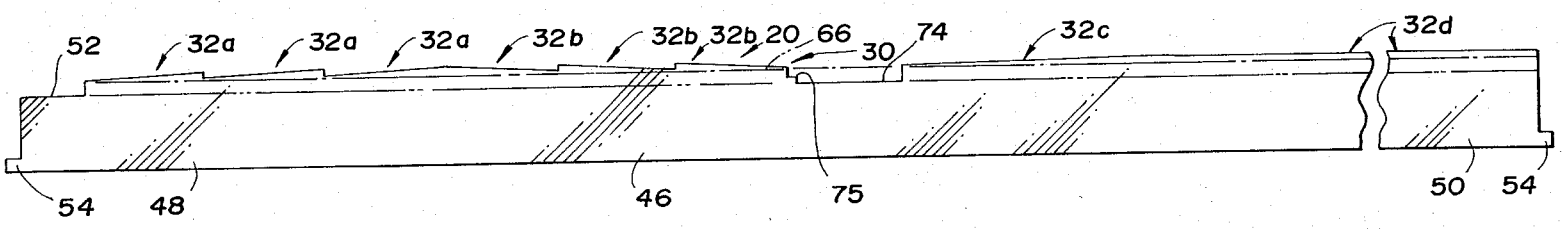
FIG. 1 is a side elevation view of a toothed die for performing thin-wall sleeve splining in accordance with the present invention.
Figure 6:
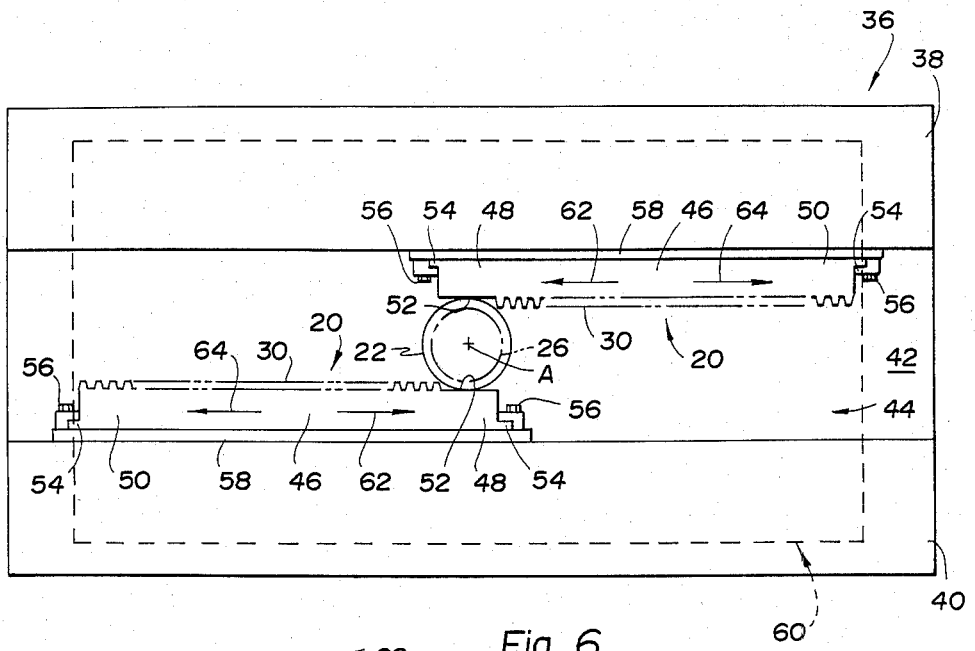
FIG. 6 is a front elevation view of a machine with which a pair of the dies are utilized to perform the thin-wall spline forming method of the invention.
Figure 8:
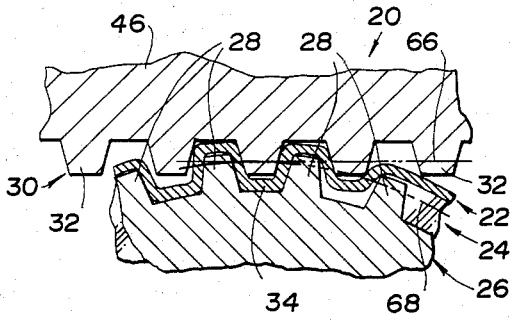
FIG. 8 illustrates the manner in which the die and mandrel teeth mesh with the thin-wall sleeve therebetween to form the splines.

Referring to FIG. 1 of the drawings, a toothed die for forming thin-wall splines in accordance with the invention is generally indicated by reference numeral 20. An annular thin-wall sleeve 22 of a power transmitting member 24 shown in FIG. 6 is initially mounted on a toothed mandrel 26 which is rotatable about a central axis A and has teeth 28 that engage the inner surface of the mounted sleeve. Die 20 has a toothed forming face 30 whose teeth 32 mesh with the mandrel teeth 28 as shown in FIG. 8 with the sleeve 22 therebetween in order to form thin-wall splines 34 in a manner which is hereinafter more fully described.

Figure 3:
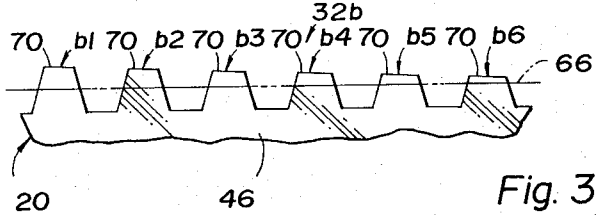
FIG. 3 is an enlarged view of another leading tooth group of the die which has teeth of a progressively decreasing height in a direction from the leading end of the die toward its trailing end.

With reference to FIGS. 1 and 3, the toothed forming face 30 of die 20 includes a plurality of leading tooth groups **32*a* and a plurality of leading tooth groups 32*b* each of which includes partial teeth of a progressively changing height from one tooth to the next tooth of the same group. Each of the leading tooth groups 32*a* and 32*b* has a length for splining an arcuate segment of the sleeve of no more than ninety degrees and has an average tooth height that is approximately equal to the average tooth height of each other leading tooth group. During the initial splining, leading tooth groups 32*a* and 32*b* initially form partial splines of a progressively changing depth over arcuate segments of the sleeve of less than ninety degrees. Forming face 30 of die 20 also includes a stepped tooth group 32***c* and a trailing tooth group 32*d* of full teeth which complete the thin-wall splining.

Figure 5:
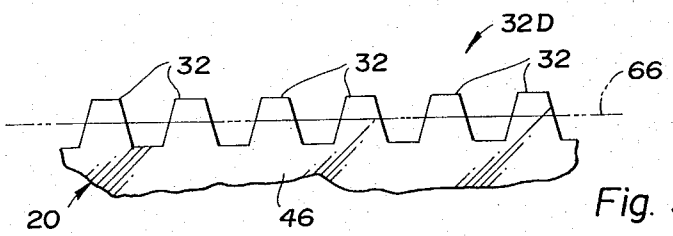
FIG. 5 is an enlarged view illustrating teeth of a trailing tooth group of the die adjacent its trailing end.

As illustrated in FIG. 5, a machine 36 having apparatus for performing the thin-wall splining operation includes upper and lower bases 38 and 40 that project forwardly from a rear connection portion 42 to define a work space 44 in which the splining is performed. A pair of upper and lower cooperable dies 20 which perform the splining are each embodied by an elongated die rack having a metallic body 46 that is made from a suitable tool steel. Each of the die racks 20 has a leading end 48 and a trailing end 50 between which the toothed forming face 30 thereof extends. At the leading end 48 of each die rack 20, a loading recess 52 is formed to permit loading of a sleeve 22 to be splined on the toothed mandrel 26 with the racks in their end-to-end position shown. End retention lugs 54 at the leading and trailing ends 48 and 50 of each die rack body 46 are secured by associated bolted clamps 56 to a rack box 58 which is mounted by an unshown movable slide on the associated machine base 38 or 40.

A schematically indicated drive mechanism 60 of machine 36 shown in FIG. 5 is preferably of the type disclosed by U.S. Pat. No. 3,793,866 and initially moves the die racks 20 along parallel paths in opposite directions as each other as indicated by arrows 62. This movement of the die racks along the upper and lower bases 38 and 40 engages the toothed forming faces 30 of the racks with the sleeve 22 at diametrically opposite locations such that the die teeth mesh with the mandrel teeth to perform the thin-wall splining of the sleeve. Drive mechanism 60 thereafter moves the die racks 20 in the opposite directions shown by arrows 64 a partial extent for unloading as is hereinafter described and substantialy moves the die racks back to their initial position shown in preparation for the next cycle.

Figure 7:
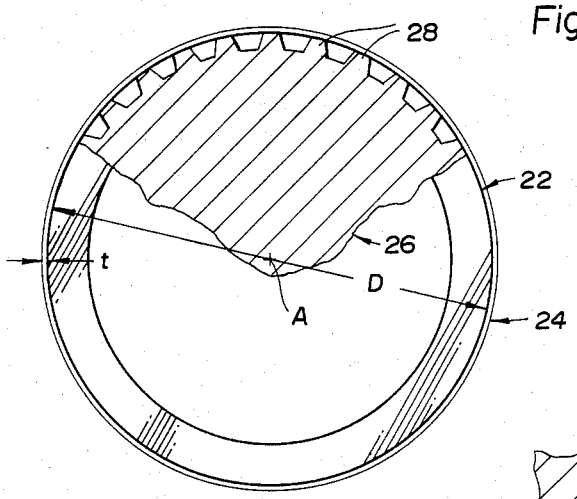
FIG. 7 is a sectional view illustrating a toothed mandrel on which the thin-wall sleeve is mounted for the splining by the pair of dies.

With reference to FIG. 7, it should be noted that whereas normal engineering terminology defines a thin-wall construction as including an internal diameter "D" to wall thickness ratio "t" of at least ten, this ratio is at least twenty for the type of splining involved with this invention and normally on the order of fifty or more. For example, the internal diameter may be on the order of about four inches with a wall thickness of about 1/16 of an inch so as to provide a ratio of sixty-four.

As seen in FIG. 1, each die rack 20 has a rectilinear pitch line 66 along which the tooth groups 32*a*, 32*b*, 32*c*, and 32*d* are disposed. As illustrated in FIG. 8, pitch line 66 of each die rack 20 is tangent to the pitch circle 68 of the toothed mandrel 26 where the mandrel teeth 28 and the rack teeth 32 have the same rate of movement.

Figure 2:
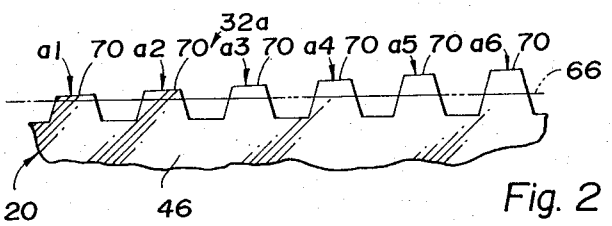
FIG. 2 is an enlarged view illustrating one leading tooth group of the die which has teeth of a progressively increasing height in a direction from the leading end of the die toward its trailing end.

As illustrated in FIGS. 2 and 3, each of the leading tooth groups 32*a* and 32*b* includes partial teeth having angled tips 70 that extend in a angular relationship to the pitch line 66 in the same plane as each other. These partial teeth can be readily formed by starting with a toothed rack having full teeth and then grinding the tooth tips with a grinding wheel to provide the angled tips 70.

As seen in FIG. 1, die rack 20 includes three of the leading tooth groups 32*a* immediately adjacent its leading end 48. Each leading tooth group 32*a* has a length for splining an arcuate segment of sixty degrees of the annular thin-wall sleeve. As illustrated in FIG. 2, each leading tooth group 32*a* includes six teeth a1, a2, a3, a4, a5, and a6 of a progressively increasing height in a direction from the leading end of the rack toward the trailing end of the rack. After the splining has been performed a sufficient extent to engage each one-half of the thin-wall sleeve with all three leading tooth groups 32*a* on one of the die racks, the partially splined sleeve 22 has the configuration illustrated in FIG. 10 wherein partial splines a1, a2, a3, a4, a5, and a6 are provided over each sixty degree arcuate segment of the sleeve. These partial splines are respectively formed by the partial teeth shown in FIG. 2 with corresponding reference identifications and have progressive depths that correspond to the heights of the partial teeth that form each partial spline.

Figure 10:
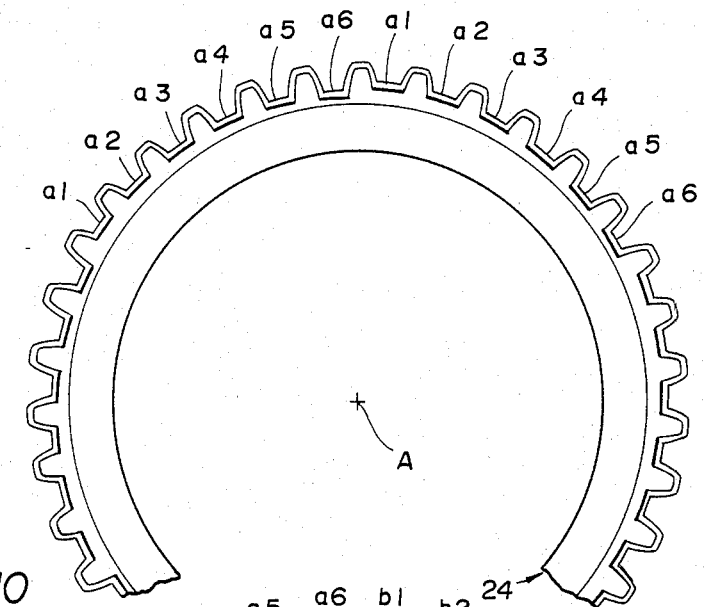
FIG. 10 is a view of the sleeve after it has been partially splined by the one leading tooth group shown in FIG. 2.
Figure 11:
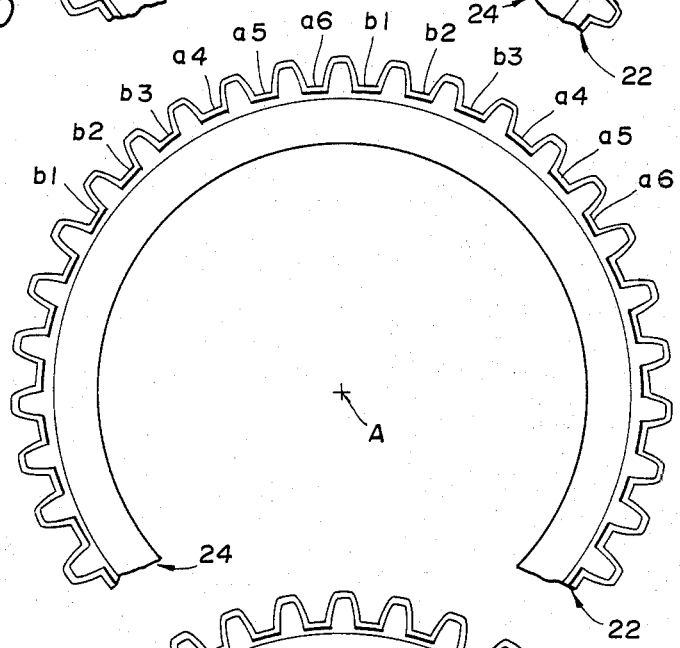
FIG. 11 is a partial view of the sleeve after it has been splined by both the leading tooth groups shown in FIGS. 2 and 3.

As seen in FIG. 1, there are three of the leading tooth groups 32*b* which are located toward the trailing end 50 of the rack from the leading tooth groups 32*a*. Each of the leading tooth groups 32*b* as illustrated in FIG. 3 has teeth b1, b2, b3, b4, b5, and b6 of a progressively decreasing height in a direction from the leading end of the rack toward the trailing end of the rack. As the splining continues such that the three leading tooth groups 32*b* on each rack engage one half of the circumference of the partially splined sleeve, the three taller teeth b1, b2, and b3 of each leading tooth group 32*b* further partially form each of the three shallower splines a1, a2, and a3 on each sixty degree arcuate sleeve segment as illustrated in FIG. 10 so as to provide the partial splines b1, b2, and b3 as illustrated in FIG. 11. The three shorter teeth b4, b5, and b6 of each leading tooth group 32*b* do not perform any further spline forming as these shorter teeth respectively mesh with the deeper splines a4, a5, and a6 that are already deeper than the shorter teeth. Thus, each sixty degree arcuate segement of the partially splined sleeve after forming by both leading tooth groups 32*a* and 32*b* as illustrated in FIG. 10 has three partial splines b1, b2, and b3 which are symmetrical about the midpoint of the segment with the three other partial splines a4, a5, and a6.

Figure 9:
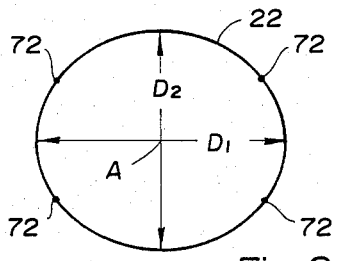
FIG. 9 is a schematic view which illustrates a slightly out of round condition of the sleeve after an initial partial splining thereof by the leading tooth groups shown in FIGS. 2 and 3 and prior to completion of the splining by the trailing tooth groups shown in FIGS. 4 and 5.

After the partial splining by the leading tooth groups 32*a* and 32*b* illustrated in FIG. 1, the sleeve 22 normally has a slightly out of round shape as schematically shown an exaggerated extent in FIG. 9 for purposes of illustration. The major and minor diameters of the partially splined sleeve 22 are identified by D1 and D2 and extend perpendicular to each other with an intersection at the central axis A, and the intersections of the minor axis D2 with the sleeve 22 at diametrically opposite locations correspond to the final locations of engagement of the teeth 32*b* of the die racks with the sleeve. Completion of the splining of the partially splined sleeve preferably commences at one of the sets of diametrically opposite locations 72 which are located sixty degress from the minor axis D2, i.e. two thirds of the distance from the minor axis D2 toward the major axis D1. This is accomplished as illustrated in FIG. 1 by providing the die rack with a sizing recess 74 that is located between the last leading tooth group 32*b* and the stepped tooth group 32*c* and which has a length equal to one sixth of the circumference of the sleeve to be splined. A suitable coordinating gear that is rotatively coupled with the toothed mandrel and meshed with a pair of coordinating racks that move with the forming racks 20 provides mandrel rotation through the sizing recess 74 such that the first tooth C1 (FIG. 4) of the stepped tooth group 32*c* provides the initial engagement as previously mentioned at the associated location 72 on the sleeve. It has been found that the thin-wall sleeve splining performed with a die sizing recess 74 as described provides best results in imparting roundness to the sleeve upon meshing thereof with the stepped tooth group 32*c*and the trailing tooth group 32*d* as is hereinafter more fully described.

With reference to FIG.1, the leading end of the recess 74 includes a root support 75 that corresponds in positioning to the root surface between the teeth 32*a* and 32*b* of the leading tooth groups. This support 75 has been found to be useful in supporting the last spline formed by the leading tooth group 32*b* closest to the sizing recess 74.

Figure 4:
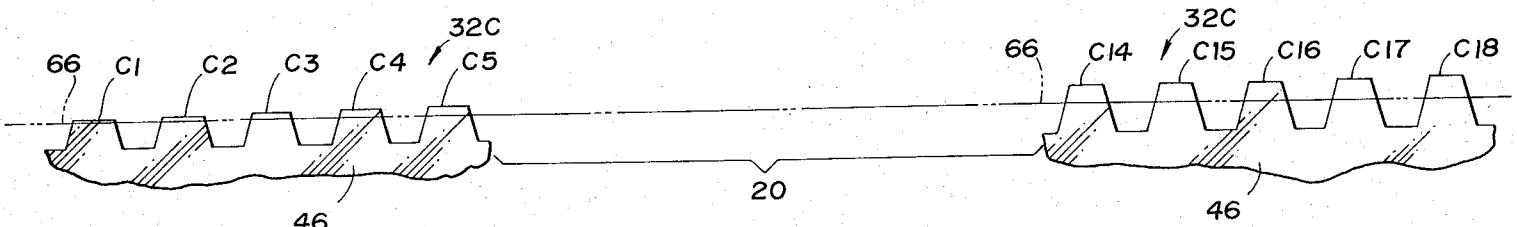
FIG. 4 is an enlarged view illustrating teeth of a stepped tooth group of the die.

As illustrated in FIG. 4, the stepped tooth group 32*c* of the die forming face is located between the recess 74 and the trailing tooth group 32*d* of full teeth. This stepped tooth group 32*c* includes teeth c1 through c18 of a progressively increasing height from the sizing recess 74 toward the trailing tooth group 32*d* of full teeth. Best results are achieved with the stepped tooth group having a length equal to about one half the circumference of the sleeve 22. Also, the shortest tooth c1 preferably has a height on the order of about slightly greater than one half to about three fourths of the height of the trailing tooth group 32*d* of full teeth, and the teeth c2 through c18 have progressively increasing heights in equal steps toward the group of full teeth. In providing the stepped tooth group 32*c*, it is best to start with teeth of the same form and positioning on the die rack 20 as the teeth of trailing tooth ground 32*d*. The tips of the teeth are then ground off to provide the stepped tooth group 32*c*.

Figure 12:
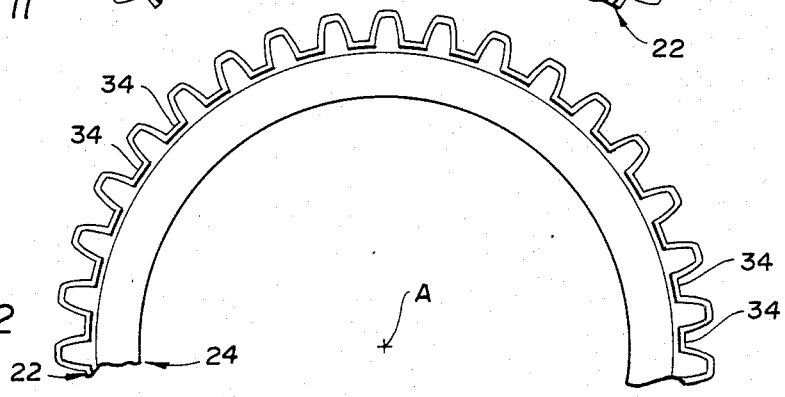
FIG. 12 is a partial view of the sleeve after it has been fully splined by the die rack.

The trailing tooth group 32*d* of full teeth 32 shown in FIG. 5 meshes with the sleeve 22 after the stepped tooth group to thereby provide forming of the sleeve from the partially splined condition to the fully splined condition shown in FIG. 12. After the completion of the splining, reverse movement of the die racks positions the splined sleeve 22 within the sizing recess 74 to permit removal thereof from the toothed mandrel prior to rack movement back to the initial position in preparation for the next cycle.

As illustrated in FIGS. 2 and 3, the shortest partial teeth a1 and b6 of the groups of partial teeth 32*a* and 32*b* each has a height of about two thirds of the height of the tallest partial teeth a6 and b1. Thus, about one third of the height of each shortest tooth a1 and b6 is ground off. Each of the tallest partial teeth a6 and b1 merely has its tip 70 ground to the angular orientation shown with a peak of the same height as prior to the grinding of the partial teeth. Partial teeth a2, a3, a4, and a5 of tooth group 32*a* and partial teeth b2, b3, b4, and b5 of tooth group 3*b* have progressively changing heights directly proportional to their locations between the shortest and tallest partial teeth.

The trailing group 32*d* of full teeth 32 shown in FIG. 5 preferably have a greater height and/or are positioned with respect to even the tallest of the partial teeth so as to have greater penetration and thereby complete the splining. The degree of greater penetration of the full teeth can vary and must be selected to provide best results for the particular thin-wall splining to be preformed. In some instances, only several thousandths of an inch of greater penetration by the full teeth is sufficient. Others will require a greater penetration by the full teeth of the trailing tooth group, such as on the order to seventy thousandths of an inch or more.

With reference to FIG. 8, the formed thin-wall splines 34 preferably have about 50% of each spline located within the pitch circle 68 and about 50% of each spline located outside of the pitch circle. It has been found that best results are achieved when the thin-wall splining is performed in this manner.

The invention also involves the method by which the thin-wall splines 34 are formed in the annular sleeve 22 of power transmitting member 24 by meshing the teeth of the pair of dies 20 with the teeth 28 of the mandrel 26 on which the sleeve is mounted between the meshing teeth. The important step in accordance with this invention is the initial forming of the complete sleeve 22 in arcuate segments of no more than ninety degrees with partial splines of a progressively changing depth along each segment with the average spline depth therealong approximately equal to the average spline depth along each other segment. After this initial partial spline forming, the full forming of the splines is performed to complete the spline forming operation.

In performing the method, it is preferable for the sleeve to be initially formed with partial splines of progressively changing depth along arcuate segments of sixty degrees. As such, there are six such segments on the partially splined sleeve prior to the completion of the splining by the full teeth of the die racks in the manner previously described. It is also preferable for the shallower splines a1, a2, and a3 along each partially formed arcuate segment to be further progressively formed in the opposite direction as the deeper splines a4, a5, and a6 such that each segement has the configuration shown in FIG. 11 with partial splines b1, b2, and b3 which are symmetrical with the partial splines a4, a5, and a6 on opposite sides of the midpoint of the arcuate segment. Out of roundness is also eliminated by the spline forming method by commencing the full forming of the splines at the locations 72 which are located along the sleeve 22 about two thirds of the distance from the minor diameter D2 toward the major diameter D1 of the out of round shape of the sleeve after the partial forming as shown in FIG. 9.

Thin-wall splining can be performed by the die 20 and method disclosed on thin-wall metal sleeves of harder and tougher metal than was previously possible. As such, more durable splined thin-wall sleeves 22 can be provided as may be required for certain applications.

While the best mode for carrying out the invention has been described in detail, those familiar with the art to which this invention relates will recognize various alternative ways for practicing the present invention as defined by the following claims.

What is claimed is:

1. In a toothed die for forming splines in a thin-wall annular sleeve of a power transmitting member by meshing the die teeth and teeth of a toothed mandrel on which the sleeve is mounted between the meshing teeth so as to thereby form thin-wall splines in the sleeve as the mandrel rotates about a central axis, said die comprising: a plurality of leading tooth groups each of which includes partial teeth of a progressively changing height from one tooth to the next tooth of the same group; each of said leading tooth groups having an average tooth height that is approximately equal to the average tooth height of each other leading tooth group; and a trailing tooth group of full teeth for completing the thin-wall splining.

2. A die as claim 1 which comprises an elongated die rack having leading and trailing ends and also having a rectilinear pitch line along which the leading and trailing tooth groups extend.

3. A die as claim 2 wherein the partial teeth of each leading tooth group have angled tips that extend in an angular relationship to the pitch line in the same plane as each other.

4. A die as in claim 2 or 3 wherein at least two of the leading tooth groups each have teeth of a progressively increasing height in a direction from the leading end of the rack toward the trailing end of the rack.

5. A die as in claim 2 or 3 wherein at least two of the leading tooth groups each have teeth of a progressively decreasing height in a direction from the leading end of the rack toward the trailing end of the rack.

6. A die as in claim 2 or 3 wherein at least one of the leading tooth groups has teeth of a progressively increasing height in a direction from the leading end of the rack toward the trailing end of the rack, and wherein at least one other of the leading tooth groups has teeth of a progressively decreasing height in a direction from the leading end of the rack toward the trailing end of the rack.

7. A die as claim 2 or 3 wherein a plurality of the leading tooth groups each have teeth of a progressively increasing height in a direction from the leading end of the rack toward the trailing end of the rack, and wherein another plurality of the leading tooth groups each have teeth of a progressively decreasing height in a direction from the leading end of the rack toward the trailing end of the rack.

8. A die as in claim 7 wherein the tooth groups having the teeth of progressively increasing height are located immediately adjacent the leading end of the rack, and wherein the tooth groups having the teeth of progressively decreasing height are located toward the trailing end of the rack from the tooth groups having the teeth of progressively increasing height.

9. A die as in claim 1, 2, or 3 further including a sizing recess between the leading tooth groups and the trailing tooth group.

10. A die as in claim 9 further including a stepped tooth group located between the sizing recess and the trailing tooth group of full teeth; and said stepped tooth group having teeth of a progressively increasing height from the sizing recess toward the trailing tooth group of full teeth.

11. In a toothed die rack for forming splines in a thin-wall annular sleeve of a power transmitting member by meshing the rack teeth and teeth of a toothed mandrel on which the sleeve is mounted between the meshing teeth so as to thereby form thin-wall splines in the sleeve as the mandrel rotates about a central axis, said die rack comprising: an elongated rack body having leading and trailing ends and a toothed forming face extending therebetween; said toothed forming face having a rectilinear pitch line and teeth positioned along the pitch line; the toothed forming face having a plurality of leading tooth groups each of which includes partial teeth of a progressively increasing height from one tooth to the next tooth of the same group in a direction from the leading end of the rack body toward the trailing end thereof; each of said leading tooth groups having an average tooth height that is approximately equal to the average tooth height of each other leading tooth group; the toothed forming face including a trailing tooth group of full teeth for completing the thin-wall splining; and the toothed forming face including a sizing recess between the leading and trailing tooth groups.

12. In a toothed die rack for forming splines in a thin-wall annular sleeve of a power transmitting member by meshing the rack teeth and teeth of a toothed mandrel on which the sleeve is mounted between the meshing teeth so as to thereby form thin-wall splines in the sleeve as the mandrel rotates about a central axis, said die rack comprising: an elongated rack body having leading and trailing ends and a toothed forming face extending therebetween; said toothed facing having a rectilinear pitch line and teeth positioned along the pitch line; the toothed forming face having a plurality of leading tooth groups each of which includes partial teeth of a progressively decreasing height from one tooth to the next tooth of the same group in a direction from the leading end of the rack body toward the trailing end thereof; each of said leading tooth groups having an average tooth height that is approximately equal to the average tooth height of each other leading tooth group; the toothed forming face including a trailing tooth group of full teeth for completing the thin-wall splining; the toothed forming face including a sizing recess between the leading trailing tooth groups; and the toothed forming face including a stepped tooth group located between the sizing recess and the trailing tooth group of full teeth and having teeth of a progressively increasing height from the sizing recess toward the trailing tooth group of full teeth.

13. In a toothed die rack for forming splines in a thin-wall annular sleeve of a power transmitting member by meshing the rack teeth and teeth of a toothed mandrel on which the sleeve is mounted between the meshing teeth so as to thereby form thin-wall splines in the sleeve as the mandrel rotates about a central axis, said die rack comprising: an elongated rack body having leading and trailing ends and a toothed forming face having a rectilinear pitch line and teeth positioned along the pitch line; the toothed forming face having a plurality of leading tooth groups at least two of which include partial teeth of a progressively increasing height from one tooth to the next tooth of the same group in a direction from the leading end of the rack body toward the trailing end thereof; at least two other of the leading tooth groups each including partial teeth of a progressively decreasing height from one tooth to the next tooth of the same group in a direction from the leading end of the rack body toward the trailing end thereof; each of said leading tooth groups having an average tooth height that is approximately equal to the average tooth height of each other leading tooth group; the toothed forming face including a trailing tooth group of full teeth for completing the thin-wall splining; the toothed forming face including a sizing recess located between the leading and trailing tooth groups and having a length equal to about one sixth the circumference of the sleeve to be splined; the toothed forming face including a stepped tooth group located between the sizing recess and the trailing tooth group of full teeth; the stepped tooth group having teeth of a progressively increasing height from the sizing recess toward the trailing tooth group of full teeth; and the stepped tooth group having a length equal to about one half the circumference of the sleeve to be splined.

14. A die rack as in claim 11, 12, or 13 wherein the partial teeth of each leading tooth group have angled tips that extend in an angular relationship to the pitch line in the same plane as each other.

15. In a toothed die rack for forming splines in a thin-wall annular sleeve of a power transmitting member by meshing the rack teeth and teeth of a toothed mandrel on which the sleeve is mounted between the meshing teeth so as to thereby form thin-wall splines in the sleeve as the mandrel rotates about a central axis, said die rack comprising: an elongated rack body having leading and trailing ends and a toothed forming face extending therebetween; said toothed forming face having a rectilinear pitch line and teeth positioned along the pitch line; the toothed forming face having six leading tooth groups each of which includes partial teeth of a progressively changing height from one tooth to the next tooth of the same group; each of said leading tooth groups having an average tooth height that is approxmately equal to the average tooth height of each other leading tooth group; a first three of the leading tooth groups being located immediately adjacent the leading end of the rack body and each having teeth of a progressively increasing height in a direction from the leading end of the rack body toward the trailing end thereof; the other three leading tooth groups being located toward trailing end of the rack body and the first three groups and each having teeth of a progressively increasing height in a direction from the leading end of the rack body toward the trailing end thereof; the other three leading tooth groups being located toward the trailing end of the rack body from the first three groups and each having teeth of a progressively decreasing height in a direction from the leading end of the rack body toward the trailing end thereof; the teeth of each of said leading tooth groups having angled tips that extend in an angular relationship to the pitch line in the same plane as each other; a trailing tooth group of full teeth adjacent the trailing end of the rack body for completing the thin-wall splining; the toothed forming face including a sizing recess located between the leading and trailing tooth groups and having a length equal to about one sixth the circumference of the sleeve to be splined; the toohted forming face including a stepped tooth group located between the sizing recess and the trailing tooth group of full teeth; the stepped tooth group having teeth of a progressively increasing height from the sizing recess toward the trailing tooth group of full teeth; and the stepped tooth group having a length equal to about one half the circumference of the sleeve to be splined.

* * * * *